US008317565B2

(12) United States Patent
Shallah

(10) Patent No.: US 8,317,565 B2
(45) Date of Patent: Nov. 27, 2012

(54) THREE DIMENSIONAL TOY BATH TUB CITY

(76) Inventor: Thomas Michael Shallah, Deland, FL (US)

( * ) Notice: Subject to any disclaimer, the term of this patent is extended or adjusted under 35 U.S.C. 154(b) by 303 days.

(21) Appl. No.: 12/804,953

(22) Filed: Aug. 4, 2010

(65) Prior Publication Data

US 2012/0034840 A1 Feb. 9, 2012

(51) Int. Cl.
*A63H 23/10* (2006.01)
*A63H 33/30* (2006.01)

(52) U.S. Cl. ..... 446/153; 446/482

(58) Field of Classification Search ..... 446/153, 446/156, 160, 476, 478, 479, 482, 227; 472/128, 472/129

See application file for complete search history.

(56) References Cited

U.S. PATENT DOCUMENTS 4,356,657 A 11/1982 Goldfarb
4,689,032 A * 8/1987 Trossman ..... 446/160
4,723,930 A * 2/1988 Freese et al. ..... 446/93
5,015,210 A 5/1991 Dideriksen
5,441,435 A 8/1995 Shiraishi
5,722,874 A * 3/1998 Horton et al. ..... 446/476
5,899,789 A 5/1999 Rehkemper
6,050,872 A 4/2000 Cahill
6,641,455 B2 * 11/2003 Chan ..... 446/297
6,648,724 B1 * 11/2003 Tammera ..... 446/476
6,852,000 B2 * 2/2005 Lee et al. ..... 446/476
6,964,595 B2 * 11/2005 Libretti ..... 446/482
7,677,949 B1 * 3/2010 Mc Millan ..... 446/476

* cited by examiner

*Primary Examiner* — Kien Nguyen

(57) ABSTRACT

A portable, lightweight, water-resistant, multi-colored toy for placement in a bathtub, either supernatant or stationary, and which can be used with small toy cars of various models includes a base member having a multi-storied superstructure on which toy cars are placed with the base member having pivotal flip-down and flip-up legs for supporting the toy in the bathtub and the legs having suction cup for adhering to the bathtub bottom and one of the floors—the top floor—including a car wash, a gas station and a convenience store with water for the car wash being provided by a conduit that extends from the water up to the car wash and the upper side of the base member including an island and a boat ramp extending to the water.

20 Claims, 4 Drawing Sheets

THREE DIMENSIONAL TOY BATH TUB CITY

FIELD OF THE INVENTION

The present invention pertains to portable, lightweight, waterproof toys, and more particularly pertains to a portable, lightweight, waterproof plastic toy for use in a bathtub.

BACKGROUND OF THE INVENTION

Toys for children run the gamut from very expensive and very complicated computer games and video games to very simple toys composed of plastic or wooden building blocks that can be snapped, joined or press-fitted together to form or create a number of different types of objects from giant robots, spaceships, construction vehicles, ships, buildings and well-known structures. Children's toys are designed to be used both indoors and outdoors and in various types of environments. One specialized area of children's toys are toys used in water games, sports, and activities, and such toys range from water guns, flotation devices, motorized boats, etc. There are also children's toys designed for indoor use in a bathtub. Such toys are often used as an inducement to get children to take bath's on a regular basis; and such toys are especially helpful in coaxing or cajoling young boys to not only get in the bathtub but to occupy the young boys so that they can be properly washed by the supervising adult. Such toys must have a number of common attributes: they must be resilient and not easily breakable with parts that fragment and splinter; they must be fun and fully engage the young child; and they must be easy to clean and store. The prior art discloses a number of toys for use by small children.

For example, the Dideriksen patent (U.S. Pat. No. 5,015,210) discloses a toy wash that is constructed from members of a toy building set that includes brush assemblies, flexible connector members and upright beams and horizontal carrier beams.

The Shiraishi patent (U.S. Pat. No. 5,441,435) discloses a trackway toy that includes at least one powered toy for movement along and on sections of track and action stations that may be in the form of an elevator and a crane in the vicinity of the track way.

The Rehkemper et al. patent (U.S. Pat. No. 5,899,789) discloses a toy track assembly with a mechanism to launch toy vehicles on the track so that a mid-air collision of the vehicles occurs includes a spiral track section, a horizontal section, and an inverted track section for creating the mid-air collision.

The U.S. Pat. No. 4,356,657 discloses an activity toy for use with toys by vehicles and more particularly pertains to such a toy stimulating features of a real life car wash.

Nonetheless, despite the ingenuity of the above devices, there remains a need for a portable, lightweight toy that can be submerged in a bathtub or other body of water for the enjoyment of children.

SUMMARY OF THE INVENTION

The present invention comprehends a bathtub toy for use in a bathtub, and that is especially attractive and enjoyable in use for young boys—although young girls can use the bathtub toy equally well—as an inducement and encouragement to not only take baths but to remain in the bathtub, and come to realize that taking baths can be an enjoyable occurrence. The bathtub toy of the present invention is lightweight, multi-colored in appearance, manufactured from a lightweight durable plastic, easy to set up in the bathtub and easy to collapse and store when the bath is done, and easy to clean.

Thus, the bathtub toy of the present invention includes a base member having an underside and an upper side. Mounted to the underside of the base member are four spaced-apart flange members, and pivotally attached to each flange member is a leg each of which is independently pivotable between an upright disposition for supporting the toy in the bathtub and a foldable disposition thereby allowing the toy to float on the surface of the water or for facilitating its movement and storage when not in use. Mounted to the lower end of each leg is a suction member that adheres to the bathtub bottom for securely affixing and maintaining the toy in a stationary position within the bathtub.

Mounted to and upwardly projecting from the upper side of the base member is a multi-floored superstructure, and in the present embodiment the superstructure includes three floors. Spaced from the superstructure is a decorative boat island. Also laterally projecting from the base member and connected thereto is a boat ramp. Located at one end of the superstructure is an elevator operable by a hand crank for raising and lowering vehicles to the several floors. The third floor has a number of structures and/or services located thereon; and in the preferred embodiment at least a gas/convenience station is disposed thereon, with the gas station including a mini mart that sells items such as food, beverage, ice cream, candy, soda, made-to-order type sandwiches and meals. The third floor also includes a car wash with a standard washing drum and spray tube terminating with a spray nozzle. A conduit connects to the spray tube and the conduit extends down through the floors and through the base member so that its open end is placed within and registers with the water in the bathtub so that water can be drawn up through the conduit and the spray tube for dispersal from the spray nozzle onto the vehicle to be washed. The bathtub toy of the present invention is thus portable, lightweight, water resistant, easy to clean, transport, and store, and provides young children with a fun-filled educational activity while taking a bath and as a result distracts and diverts the child's attention so that the adult can more easily attend to the child.

It is an objective of the present invention to provide a bathtub toy that is lightweight, durable, and made of plastic.

It is another objective of the present invention to provide a bathtub toy that can be used with various types of toy vehicles such as Matchbox® and Hot Wheels®.

It is yet another objective of the present invention to provide a bathtub toy that is fun for children to play with while taking a bath and also provides for bonding time with siblings and parents.

It is still yet another objective of the present invention to provide a bathtub toy that is a three-dimensional toy that allows young children to play with toy cars in their bathtub.

It is still yet a further objective of the present invention to provide a bathtub toy for children that has few moving parts, is waterproof and is multi-colored.

Still another objective of the present invention is to provide a bathtub toy for children that includes flip down or foldable legs that facilitates the storage of the bathtub toy when not in use.

Still yet another objective of the present invention is to provide a bathtub toy for children that will encourage children, and especially boys, to get into the bathtub more often.

Still yet a further objective of the present invention is to provide a bathtub toy for children that will facilitate and improve hand-to-eye coordination in children.

These and other objects, features, and advantages will become apparent to those skilled in the art upon a perusal of the following detailed description read in conjunction with the accompanying drawing figures and appended claims.

DETAILED DESCRIPTION OF THE PREFERRED EMBODIMENT

Figure 1:
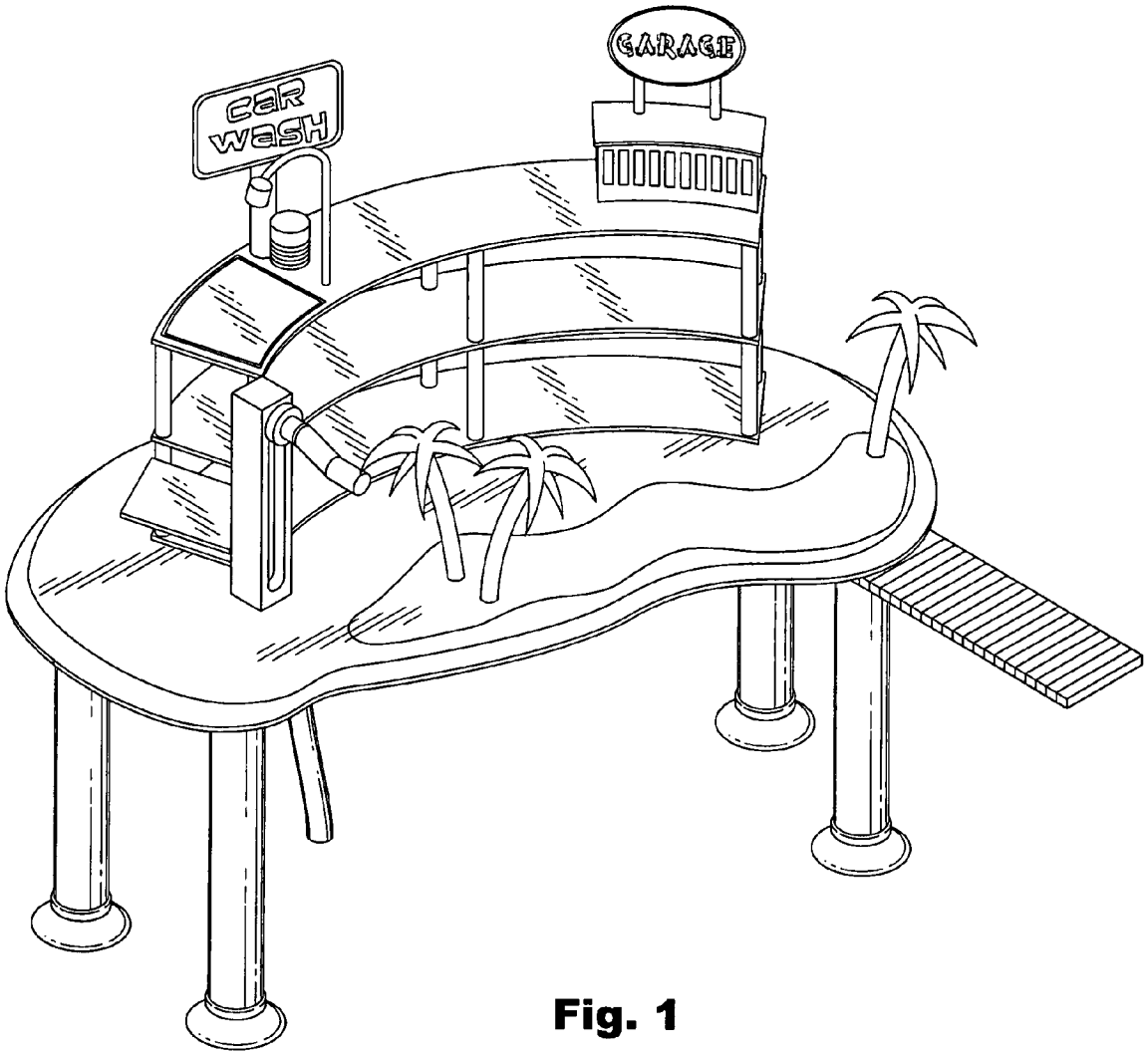
FIG. 1 is perspective view of the portable, plastic, lightweight bathtub toy of the present invention for placement in a bathtub.
Figure 2:
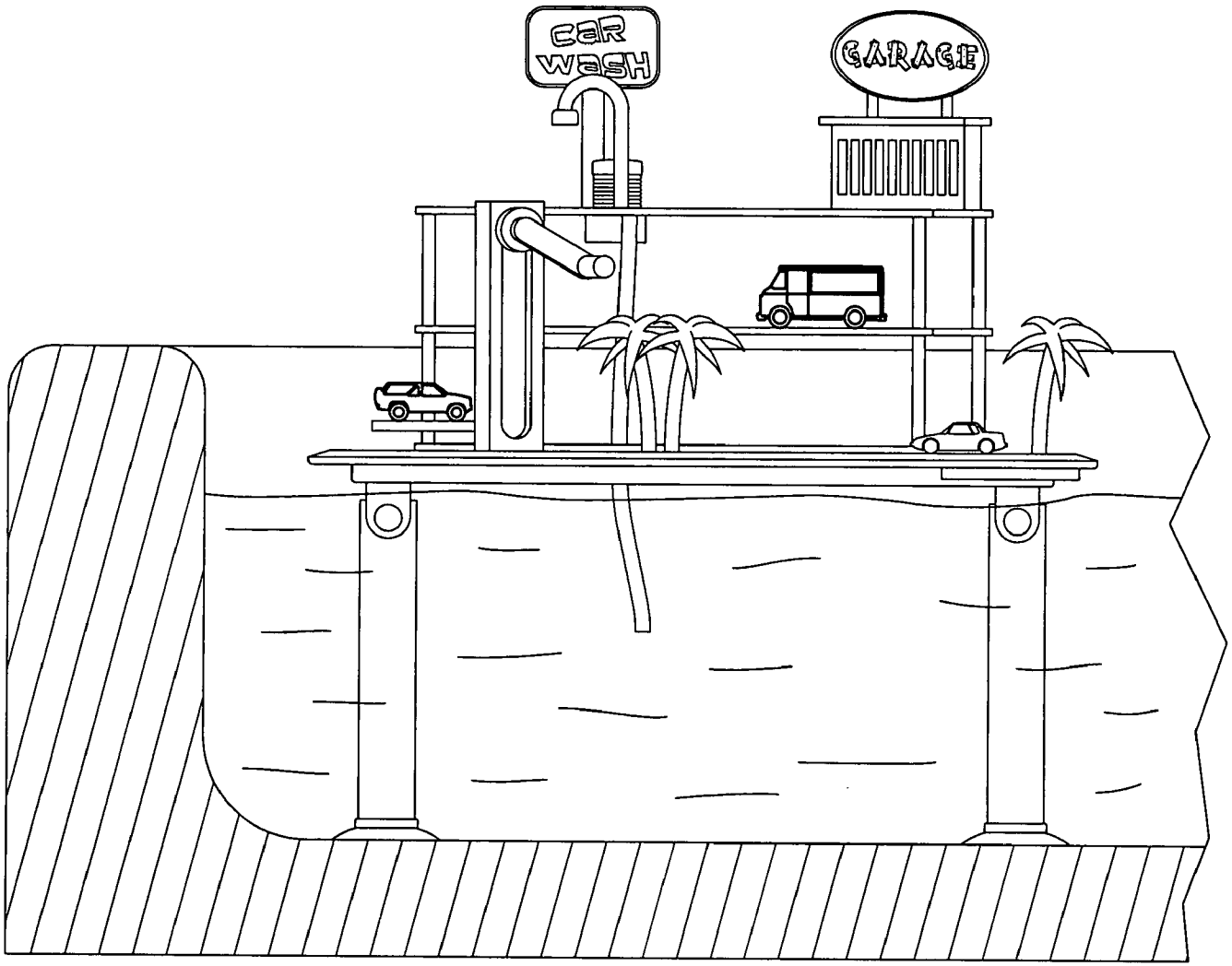
FIG. 2 is a side elevational view of the portable, plastic, lightweight bathtub toy of the present invention for placement in a bathtub with the legs of the bathtub toy affixed to the floor of the bathtub.
Figure 3:
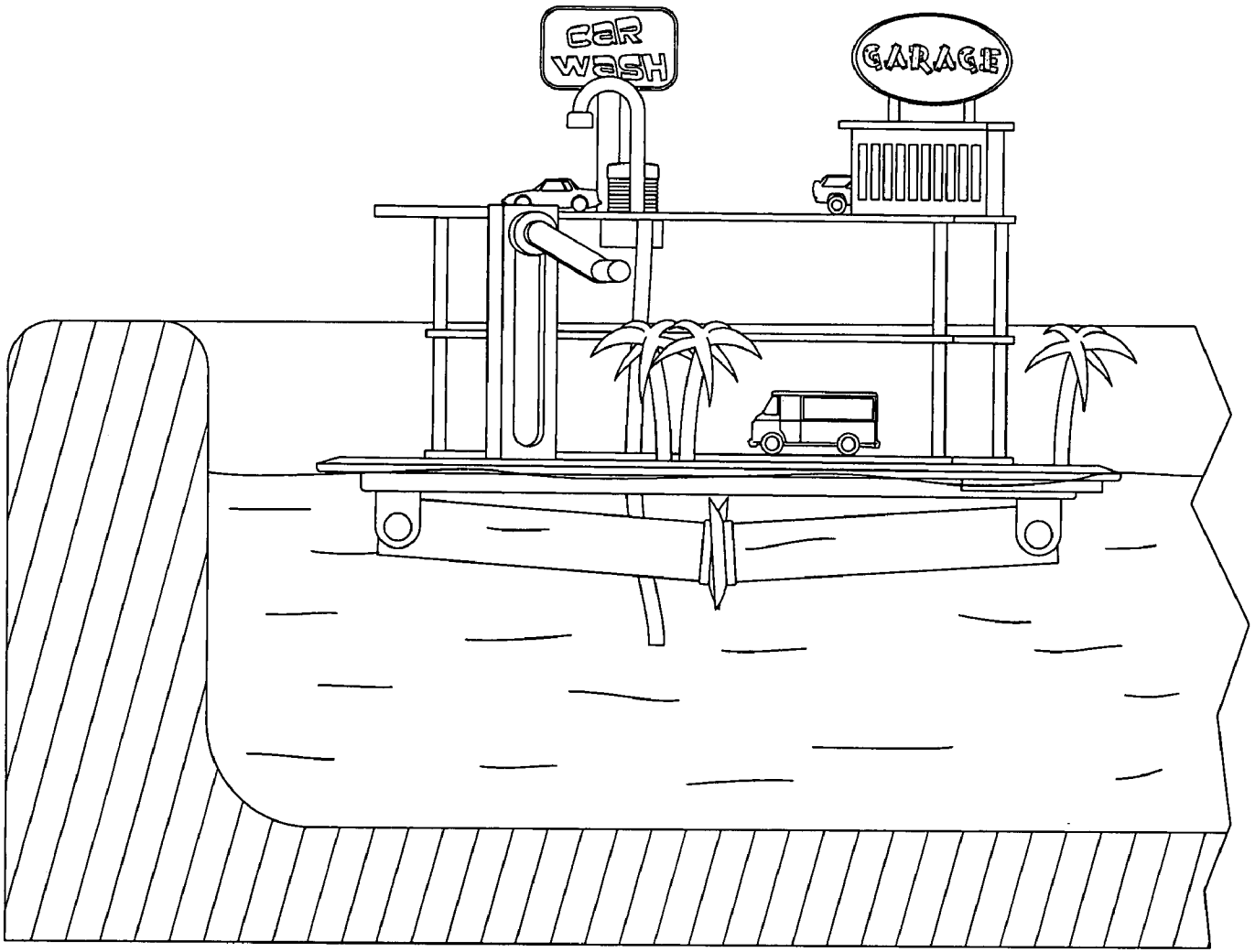
FIG. 3 is a side elevational view of the portable, plastic, lightweight bathtub toy of the present invention showing the legs of the bathtub toy folded beneath the platform thereby allowing the bathtub toy to float on the water contained within the bathtub.
Figure 4:
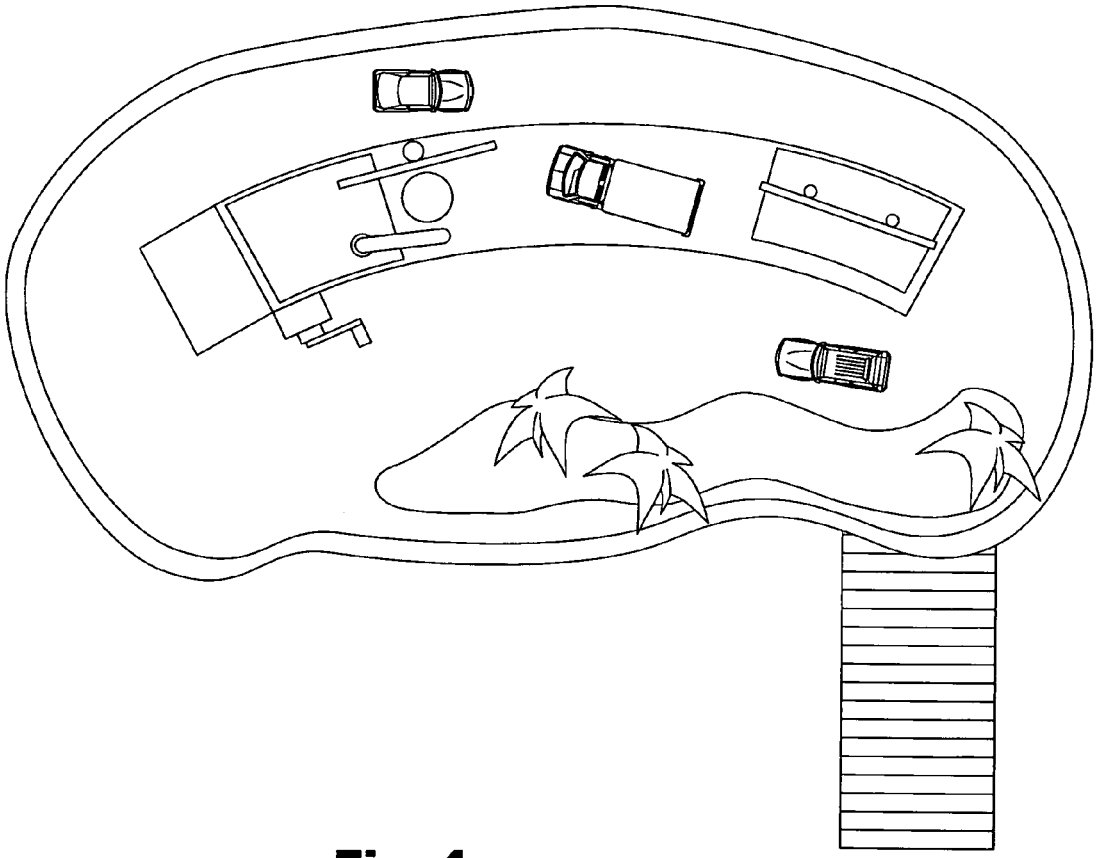
FIG. 4 is a top plan view of the portable, plastic, lightweight bathtub toy of the present invention illustrating the structures disposed on the top or third floor of the superstructure and also several vehicles located thereon.

Illustrated in FIGS. 1-4 is a bathtub toy 10 that is used in conjunction with small toy vehicles 12—cars, trucks, and construction vehicles, etc. of well-known brands and companies—to make the process of taking a bath for small children easier and more enjoyable. The bathtub toy 10 is lightweight, waterproof, multi-colored, easy to set up in the bathtub and easy to store and transport, and is able to float upon the water or can be secured to the bottom of the bathtub for stationary placement therein. The various pieces of the bathtub toy 10 can be snapped together and unsnapped for easy and quick assembly and disassembly.

As shown in FIGS. 1-4, the bathtub toy 10 of the present invention is preferably disposed in a bathtub 14 having a continuous sidewall 16 that defines a continuous inner surface 18, a bottom or floor 20, and which is filled with water 22 filled up to or within a certain distance of the inside top side or flat upper ledge 24 of the bathtub sidewall 16. The bathtub toy 10 is designed to float upon the surface 26 of the water 22 or can be anchored in a stationary position within the bathtub 14. The bathtub toy 10 of the present invention includes a primary platform or base member 28 having an underside 30 and an upper side 32. Mounted to the underside 30 and spaced from each other is a plurality of flange members 34 with the embodiment shown in FIGS. 1-4 including four spaced-apart flange members 34. Pivotally mounted to each flange member 34 is a leg or upright 36 with each leg 36 having an upper leg end 38 and an opposite lower leg end 40. The legs 36 are foldable to a disposition immediately beneath the underside 30 of the base member 28 thereby allowing the base member 28—and the bathtub toy 10 itself—to float on the water 22; and the legs 36 can be flipped down for supporting the bathtub toy 10 in the bathtub 14 and in a stationary disposition. Mounted at the lower leg end 40 of each leg 36 is a suction cup 42 for adhesion to the floor 20 of the bathtub 14 to firmly secure the bathtub toy 10 in a stationary position within the bathtub 14. The suction cups 42 can be easily adhered to and released from the bottom 20 of the bathtub 14.

As shown in FIGS. 1-4, the bathtub toy 10 includes a main superstructure or play structure 44 attached to the upper side 32 of the base member 28 and projecting upwardly therefrom. Adjacent to the superstructure 44 is an island 46 having several palm trees 48 spaced thereon. The superstructure 44 is a multi-storied structure or play structure, and in the present embodiment includes three floors or levels, and the levels can be considered as parking garage levels: a first floor 50, a second floor 52, and a third floor 54. Attached to and laterally projecting from or cantilevered from the island 46 is a boat ramp 56 having a distal end that descends partially into the bathtub water 22 to allow toys boats to dock beside it. Located adjacent to one end of the superstructure 44 is a tower 58 having a vertical slot 60 on one side thereon and a manually operable hand crank or crank handle 62 projecting from the slot 60. The crank handle 62 is mechanically interconnected to an auto elevator 64 that can be raised or lowered between and among the first 50, second 52, and third floors 54. Pillars 66 separate the first and second floors 50 and 52, and pillars 66 also separate the second 52 and third floors 54.

As illustrated in FIGS. 1-4, a number of play structures can be located on the various floors 50, 52 and 54, and the present embodiment has a number of play structures 68 located on the third floor 54. Among the play structures 68 on the third floor 54 is a car wash assembly that includes a washer/rinse drum 70 against which the vehicle 12 is passed as part of the car washing process. Projecting up through the base member 28, the first 50, second 52 and third floors 54 is a conduit 72. The conduit 72 has a lower open end 74 that is immersed in and communicates with the water 22 in the bathtub 14 and the conduit 72 projects above the third floor 54 and includes a u-shaped distal end 76 that curves down over the third floor 54. The conduit 72 serves as a suction for water pickup. The u-shaped distal end 76 terminates with a spray nozzle 78 that sprays water drawn from the bathtub 14 onto the toy vehicles 12 to be washed. In addition, a car wash sign 80 is located adjacent the drum 70 and sprayer conduit 72 and nozzle 78 stating that this is the car wash area. Located on the opposite end of the third floor 54 is a structure that serves as a gas station/convenience store building 82. The gas station/convenience store 82 is similar to a mini-mart and can sell everything from ice, soda, candy, prepared sandwiches, snacks, milk, etc. The gas station/convenience store 82 is positioned so that the children can park their toy vehicles 12 beside the building 82.

A preferred embodiment of the invention has been shown and disclosed herein, and it should be understood that numerous modifications, alterations, and variations are possible and practicable to those skilled in the art while still coming within the ambit and spirit of the invention and the scope of the invention as set forth in and by the appended claims.

I claim:

1. A bathtub toy for placement in the bathtub in a stationary disposition and on and above the surface of the water in the bathtub so that children in the bathtub can play with the bathtub toy while taking a bath, comprising:

a base member having an upper side and an underside;

a plurality of spaced-apart flange members mounted to the underside;

a plurality of legs with one leg pivotally mounted to one corresponding flange member so that the legs can be unfolded to an upright disposition and folded immediately adjacent the underside of the base member;

a boat ramp attached to and laterally projecting from the base member and partially extending to the water in the bathtub;

a play superstructure mounted to the upper side of the base member and including a first floor, a second floor, and a third floor with a plurality of pillars spaced between and separating the second floor from the first floor and the third floor from the second floor;

a tower mounted beside the play superstructure and having a slot extending along the vertical length thereof;

a hand crank disposed within the slot and manually rotatable by the playing children;

an auto elevator interconnected to the hand crank and vertically movable between and to each of the floors for raising and lowering vehicles on the play superstructure; and at least one play structure located on the third floor so that the children playing in the bathtub can interact with the play structure while playing with their toy vehicles and toy boats.

2. The bathtub toy of claim 1 wherein the legs, the base member, and the play superstructure are composed of durable, water resistant plastic.

3. The bathtub toy of claim 2 wherein the base member can float on the surface of the water when the legs are folded beneath and adjacent to the underside of the base member.

4. The bathtub toy of claim 3 wherein each leg includes an upper leg end and a lower leg end with the upper leg end of each leg being pivotably attached to each corresponding flange member.

5. The bathtub toy of claim 4 further comprising a plurality of suction cups with each suction cup attached to the lower leg end of each corresponding leg.

6. The bathtub toy of claim 5 further comprising an island located on the upper side of the base member.

7. The bathtub toy of claim 6 further comprising a plurality of trees mounted to the island.

8. The bathtub toy of claim 7 further comprising at least one play structure disposed upon the third floor of the play superstructure.

9. The bathtub toy of claim 8 wherein the play structure is a car wash.

10. The bathtub toy of claim 9 wherein the play structure is a gas station and convenience store.

11. A bathtub toy for placement in the bathtub in a stationary disposition and on and above the surface of the water in the bathtub so that children in the bathtub can play with the bathtub toy while taking a bath, comprising:

a base member having an upper side and an underside;

a plurality of spaced-apart flange members mounted to the underside;

a plurality of legs with one leg pivotally mounted to one corresponding flange member so that the legs can be unfolded to an upright disposition and folded immediately adjacent the underside of the base member;

a play superstructure mounted to the upper side of the base member and including a first floor, a second floor, and a third floor with a plurality of pillars spaced between and separating the second floor from the first floor and the third floor from the second floor;

a tower mounted beside the play superstructure and having a slot extending along the vertical length thereof;

a hand crank disposed within the slot and manually rotatable by the children playing in the bathtub;

an auto elevator interconnected to the hand crank and vertically movable between and to each of the floors for raising and lowering vehicles on the play superstructure; and at least one play structure located on the third floor so that the children playing in the bathtub can interact with the play structure while playing with the toy vehicles and toy boats.

12. The bathtub toy of claim 11 further comprising a boat ramp attached to and laterally projecting from the base member and partially extending to the water in the bathtub.

13. The bathtub toy of claim 12 wherein the legs, the base member, and the play superstructure are composed of durable, water resistant plastic.

14. The bathtub toy of claim 13 wherein the base member can float on the surface of the water when the legs are folded beneath and adjacent to the underside of the base member.

15. The bathtub toy of claim 14 wherein each leg includes an upper leg end and a lower leg end with the upper leg end of each leg being pivotably attached to each corresponding flange member.

16. The bathtub toy of claim 15 further comprising a plurality of suction cups with each suction cup attached to the lower leg of each corresponding leg.

17. The bathtub toy of claim 16 further comprising an island located on the upper side of the base member.

18. The bathtub toy of claim 17 further comprising at least one play structure disposed upon the third floor of the play superstructure.

19. The bathtub toy of claim 18 wherein the play structure is a car wash.

20. The bathtub toy of claim 19 wherein the play structure is a convenience store and gas station.

* * * * *